US011139611B2

(12) United States Patent
Byrne et al.

(10) Patent No.: US 11,139,611 B2
(45) Date of Patent: Oct. 5, 2021

(54) ELECTRICAL RECEPTACLE WITH DRAIN-THROUGH FEATURE

(71) Applicants: Norman R. Byrne, Ada, MI (US); Aaron G. Lautenbach, Rockford, MI (US)

(72) Inventors: Norman R. Byrne, Ada, MI (US); Aaron G. Lautenbach, Rockford, MI (US)

( * ) Notice: Subject to any disclaimer, the term of this patent is extended or adjusted under 35 U.S.C. 154(b) by 0 days.

(21) Appl. No.: 16/895,687

(22) Filed: Jun. 8, 2020

(65) Prior Publication Data

US 2020/0388955 A1 Dec. 10, 2020

Related U.S. Application Data

(60) Provisional application No. 62/859,102, filed on Jun. 8, 2019.

(51) Int. Cl.
*H01R 13/447* (2006.01)
*H01R 13/52* (2006.01)
*H01R 13/512* (2006.01)

(52) U.S. Cl.
CPC ..... *H01R 13/5227* (2013.01); *H01R 13/447* (2013.01); *H01R 13/512* (2013.01)

(58) Field of Classification Search
CPC ..... H01R 13/5227; H01R 13/447; H01R 13/512; H01R 13/4534; H01R 24/78
See application file for complete search history.

(56) References Cited

U.S. PATENT DOCUMENTS

| | | | |
|---|---|---|---|
| 2,477,803 | A | 8/1949 | Huber |
| 2,528,014 | A | 10/1950 | Moses, Jr. et al. |
| 2,610,999 | A | 9/1952 | Silver |
| 2,740,943 | A | 4/1956 | Young |
| 2,770,786 | A | 11/1956 | Czyzewski |
| 3,222,631 | A | 12/1965 | Cohen |
| 3,238,492 | A | 3/1966 | Houston |
| 3,601,758 | A | 8/1971 | Davidsson |
| 3,736,547 | A | 5/1973 | Koenig |
| 4,094,569 | A | 6/1978 | Dietz |

(Continued)

FOREIGN PATENT DOCUMENTS

| | | | |
|---|---|---|---|
| CN | 2449374 | Y | 9/2001 |
| CN | 2681385 | Y | 2/2005 |

(Continued)

*Primary Examiner* — Tho D Ta
(74) *Attorney, Agent, or Firm* — Gardner, Linn, Burkhart & Ondersma LLP

(57) ABSTRACT

An electrical power outlet is suitable for mounting face-up in locations that may be susceptible to liquid spills. The outlet includes a housing body defining an interior chamber, with an intermediate wall positioned therein. The intermediate wall defines contact openings that are open to contact passageways in which electrical contacts are mounted. A pair of drainage passageways extend through the housing body. A pair of drainage channels extend along the intermediate wall to the respective drainage passageways, so that liquid along the intermediate wall is directed along the drainage channels to the drainage passageways. Drain openings formed in a bottom wall of the housing body are in fluid communication with the respective drainage channels for draining liquid out of the housing body.

20 Claims, 13 Drawing Sheets

(56) References Cited

U.S. PATENT DOCUMENTS 4,168,104 A 9/1979 Buschow
4,379,607 A 4/1983 Bowden, Jr.
4,493,517 A 1/1985 Hillary
4,544,219 A 10/1985 Barkas
4,584,430 A 4/1986 Belknap
4,722,693 A 2/1988 Rose
4,822,290 A 4/1989 Cauley et al.
4,867,694 A 9/1989 Short
4,952,753 A * 8/1990 Hayashi ..... B60R 16/027 174/559
5,006,075 A 4/1991 Bowden, Jr.
5,011,419 A 4/1991 Maan
5,020,997 A 6/1991 Calderara et al.
5,069,630 A 12/1991 Tseng et al.
5,267,870 A 12/1993 Maresh
5,281,156 A 1/1994 Yi
5,374,199 A 12/1994 Chung
5,518,132 A 5/1996 Chen
5,839,909 A 11/1998 Calderara et al.
5,915,981 A 6/1999 Mehta
6,056,564 A 5/2000 Huang
6,086,391 A 7/2000 Chiu
6,146,160 A 11/2000 Chang
6,149,446 A 11/2000 Yu
6,217,353 B1 4/2001 Yu-Tse
6,224,401 B1 5/2001 Yu
6,238,224 B1 5/2001 Shao
6,332,781 B1 12/2001 Ito
6,394,826 B1 5/2002 Baxter et al.
6,422,880 B1 7/2002 Chiu
6,537,088 B2 3/2003 Huang
6,555,771 B2 4/2003 Shao
6,537,089 B1 5/2003 Montague
6,739,887 B1 5/2004 Yu
6,753,755 B2 6/2004 Montague
6,767,228 B2 7/2004 Katz
6,776,630 B1 8/2004 Huang
6,786,744 B1 9/2004 Lee
6,786,745 B1 9/2004 Huang
6,814,594 B1 11/2004 Huang
6,893,275 B2 5/2005 Ng et al.
6,932,631 B2 8/2005 Huang
6,943,297 B2 9/2005 Capella
6,969,801 B2 11/2005 Radosavljevic et al.
7,114,968 B2 10/2006 Healy
7,179,992 B1 2/2007 Packard et al.
7,214,101 B1 5/2007 Tong
7,312,394 B1 12/2007 Weeks et al.
7,312,963 B1 12/2007 Radosavljevic et al.
7,355,117 B2 4/2008 Castaldo et al.
7,438,567 B2 10/2008 Nalwad et al.
7,452,221 B1 11/2008 Oddsen et al.
7,455,538 B2 11/2008 Germain
7,510,412 B1 3/2009 Valentin
7,537,468 B1 5/2009 Huang et al.
7,551,047 B2 6/2009 Sokolow et al.
7,554,033 B1 6/2009 Bhosale et al.
7,556,513 B2 7/2009 Ng et al.
7,588,447 B1 9/2009 Ni
7,633,009 B1 12/2009 Baldwin
7,637,756 B1 12/2009 Hsu
7,642,457 B2 1/2010 Weeks et al.
7,645,148 B2 1/2010 Carbone et al.
7,645,149 B2 1/2010 Carbone et al.
7,651,347 B2 1/2010 Germain et al.
7,651,348 B2 1/2010 Huang et al.
7,695,293 B1 4/2010 Sikes
7,722,389 B2 5/2010 Benoit et al.
7,753,700 B2 7/2010 Ma
7,785,128 B2 * 8/2010 Ito ..... H01R 13/631 439/352
7,790,982 B2 9/2010 Weeks et al.
7,820,909 B2 10/2010 Castaldo et al.
7,833,030 B1 11/2010 Huang
7,868,719 B2 1/2011 Bazayev et al.
7,869,171 B2 1/2011 Weeks et al.
7,883,346 B2 2/2011 Huang
7,887,346 B1 2/2011 Huang
7,887,349 B1 2/2011 Macomber
7,914,307 B1 3/2011 Yang
7,934,935 B1 5/2011 Gao
7,938,676 B1 5/2011 Patel et al.
7,942,681 B2 5/2011 Ni
7,985,085 B2 7/2011 Gao
7,997,925 B2 8/2011 Lam et al.
8,007,296 B2 8/2011 Chen et al.
8,044,299 B2 10/2011 Weeks
8,062,072 B2 11/2011 Ziobro
8,063,303 B1 11/2011 McBain
8,100,705 B2 1/2012 Chen et al.
8,105,094 B2 1/2012 Patel et al.
8,147,260 B2 4/2012 Huang
8,187,011 B1 5/2012 Baldwin et al.
8,187,012 B1 5/2012 Baldwin et al.
8,193,445 B2 6/2012 Li
8,242,362 B2 8/2012 Castaldo et al.
8,297,990 B2 10/2012 Huang
8,366,463 B2 2/2013 Zhang et al.
8,382,497 B2 2/2013 Huang
8,435,055 B1 5/2013 Bhosale
8,462,006 B2 6/2013 Chen
8,465,305 B2 6/2013 Wilkie et al.
8,480,415 B2 7/2013 Byrne
8,480,420 B2 7/2013 Ziobro
8,491,319 B1 7/2013 Baldwin et al.
8,512,065 B2 8/2013 Byrne et al.
8,523,599 B2 9/2013 Lazzaro
8,550,829 B2 10/2013 Huang
8,562,362 B2 10/2013 Jiang et al.
8,568,152 B1 10/2013 Weeks
8,616,904 B1 12/2013 Martin et al.
8,632,347 B2 1/2014 Chen et al.
8,632,348 B2 1/2014 Baldwin et al.
8,662,910 B2 * 3/2014 Ichio ..... H01R 43/005 439/206
8,672,695 B2 3/2014 Baldwin et al.
8,764,463 B2 7/2014 Byrne et al.
9,059,530 B2 * 6/2015 Byrne ..... H01R 13/4534
9,270,047 B2 2/2016 Byrne et al.
9,368,924 B2 6/2016 Byrne et al.
9,692,189 B2 * 6/2017 Lin ..... H01R 13/521
2004/0203270 A1 10/2004 Wang
2005/0178576 A1 * 8/2005 Saka ..... H01R 13/5227 174/66
2009/0286411 A1 11/2009 Bazayev et al.
2010/0159722 A1 6/2010 Chen
2010/0317208 A1 12/2010 Chen et al.
2011/0092085 A1 4/2011 Gao
2011/0263145 A1 10/2011 Kim
2012/0170292 A1 7/2012 Bhosale et al.
2012/0287572 A1 11/2012 Huang
2013/0141822 A1 6/2013 Weeks et al.

FOREIGN PATENT DOCUMENTS

GB 2068651 8/1981
JP 2006040733 A 2/2006
KR 10-2011-0134778 12/2011
RU 2125329 C1 1/1999

* cited by examiner

ELECTRICAL RECEPTACLE WITH DRAIN-THROUGH FEATURE

CROSS REFERENCE TO RELATED APPLICATION

The present application claims the benefit of U.S. provisional application Ser. No. 62/859,102, filed Jun. 8, 2019, which is hereby incorporated herein by reference in its entirety.

FIELD OF THE INVENTION

The present invention relates to electrical receptacles and, more particularly, to electrical receptacles that may be mounted in a generally face-up orientation and potentially exposed to liquids from inadvertent spills.

BACKGROUND OF THE INVENTION

Electrical receptacles or outlets, such as 110V AC or 220V AC simplex or duplex outlets or the like, are typically designed to receive at least two or three conductive prongs of an electrical plug associated with an electrical consumer, such as an appliance. The electrical receptacles have faces defining openings that receive respective prongs of an electrical plug, and have female electrical contacts spaced behind the openings. When such electrical receptacles are mounted in generally-face up orientations in which water or other liquids could pool on the face, there is posed a risk that the liquid could "bridge" between adjacent openings and thereby establish electrical continuity across electrical contacts inside the receptacle, creating a short circuit hazard and the risk of electric shock due to contact with electrically energized liquid by a user touching the outlet face.

SUMMARY OF THE INVENTION

The present invention provides an electrical power receptacle that can be mounted in a face-up orientation in environments that are prone to liquids falling on the face of the receptacle and through one or more of the receptacle's openings. This tolerance for liquid is achieved by isolating the liquid that might contact any one of the electrical contacts within the receptacle from the liquids that might contact any of the other electrical contacts within the receptacle, and routing the isolated liquids outwardly through the bottom of the receptacle. Liquids that enter the receptacle through the line or neutral openings in the receptacle face are divided inside the receptacle and kept isolated after the initial dividing, so that they exit on one side of the receptacle or the other depending on the initial path they follow out of a slider chamber. Any liquid entering the ground contact exits the bottom of the receptacle, near the center, through its own isolated exit opening.

According to one form of the present invention, an electrical power outlet includes a housing body defining an interior chamber, an intermediate wall in the chamber, a pair of contact passageways, a pair of drainage passageways, a pair of drainage channels, and a pair of drain openings. The housing body includes a face with a pair of outlet openings, a bottom wall spaced from the face, and a sidewall extending between the face and the bottom wall to define an interior chamber. The intermediate wall has an upper surface defining a pair of contact openings. The contact passageways are defined through the interior chamber and are open to respective contact openings. The drainage passageways extend upwardly from the bottom wall through the interior chamber. The drainage channels extend along the upper surface of the intermediate wall to respective ones of the drainage passageways. The drain openings are formed in the bottom wall and are in fluid communication with respective drainage channels.

In one aspect, a first drainage channel cooperates with a first of the drainage passageways and a first of the drain openings to define a first flow path. A second of the drainage channels cooperates with the second drainage passageway and the second drain opening to define a second flow path that is isolated from the first flow path.

In another aspect, the drainage passageways are spaced apart and isolated from one another and from each of the contact passageways.

In yet another aspect, there is a pair of contact drain openings formed in the bottom wall and in fluid communication with respective ones of the drainage channels. The contact drain channels are positioned below respective contact passageways.

In a further aspect, there is a pair of upright divider walls disposed between the intermediate wall and respective ones of the drainage passageways. The upright divider walls define respective openings that form respective portions of the drainage channels.

Therefore, the electrical power receptacles of the present invention provide drain-through capability for liquids that inadvertently fall upon an face of the receptacle and enter outlet openings formed in the face. The liquid follows separate drainage pathways through the receptacle and exits and opposite end of the receptacle.

These and other objects, advantages, purposes and features of the present invention will become apparent upon review of the following specification in conjunction with the drawings.

BRIEF DESCRIPTIONS OF THE DRAWINGS

Figure 1:
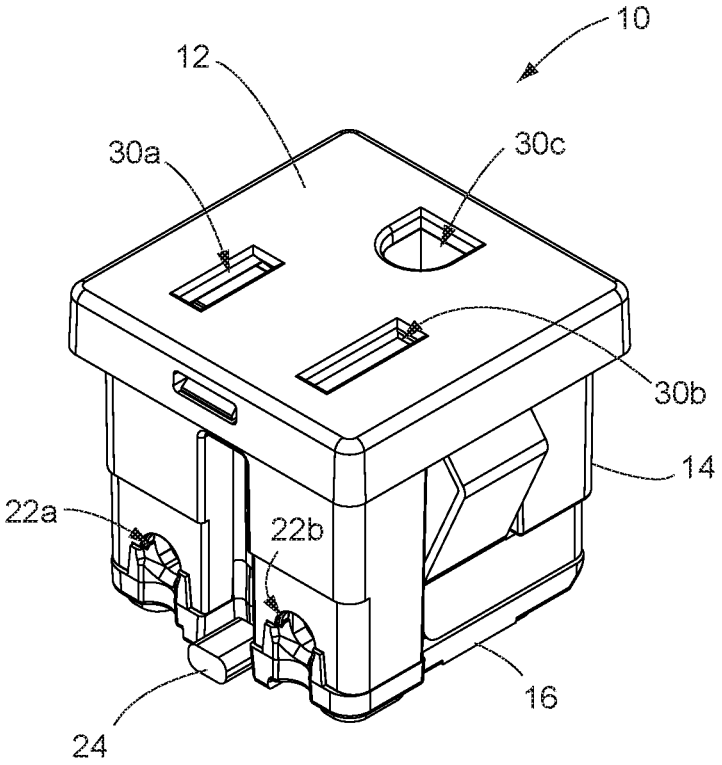
FIG. 1 is a top perspective view of an electrical receptacle assembly in accordance with the present invention, viewed from a front-right side.
Figure 2:
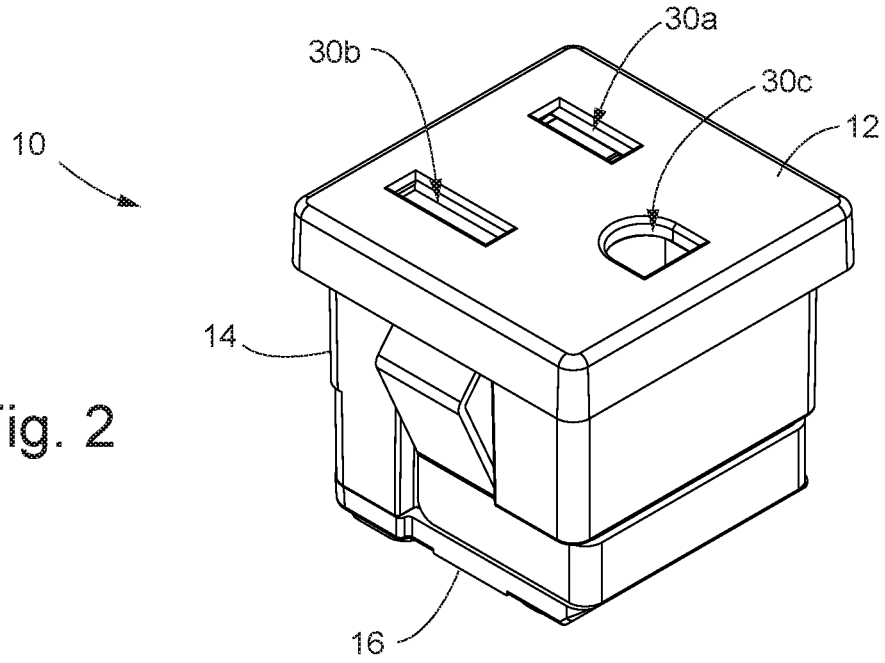
FIG. 2 is another top perspective view of the electrical receptacle assembly of FIG. 1, viewed from a back-right side.
Figure 7:
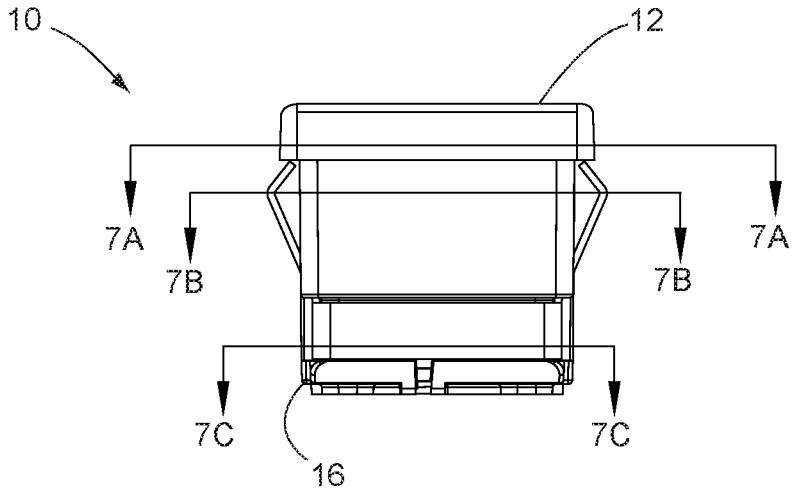
FIG. 7 is a rear elevation of the electrical receptacle assembly of FIG. 1.
Figure 7A:
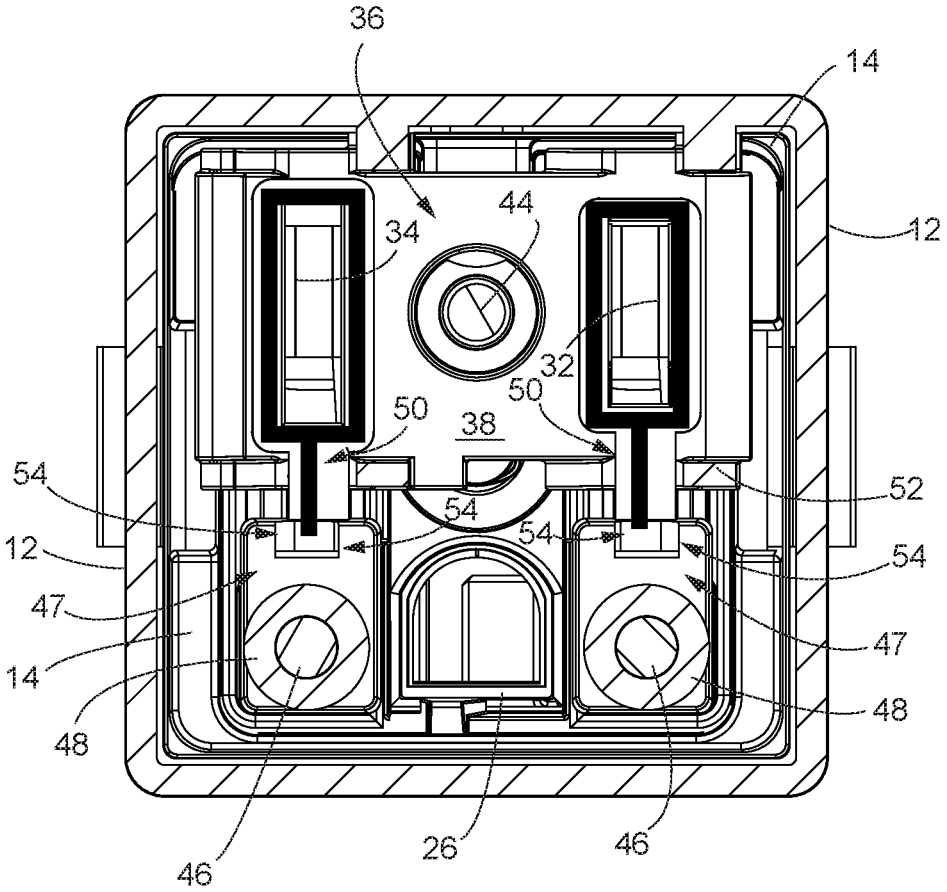
Figure 7B:
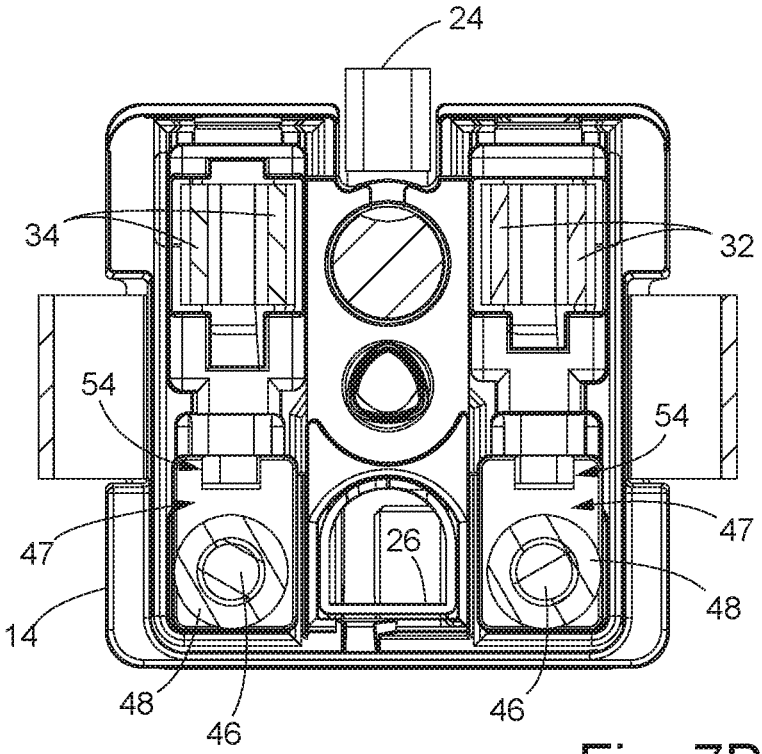
Figure 7C:
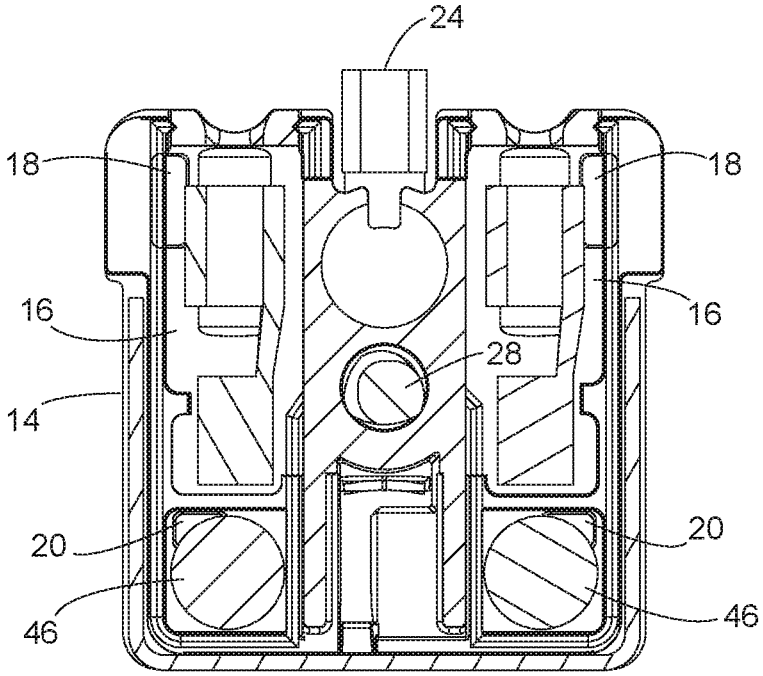
Figure 8:
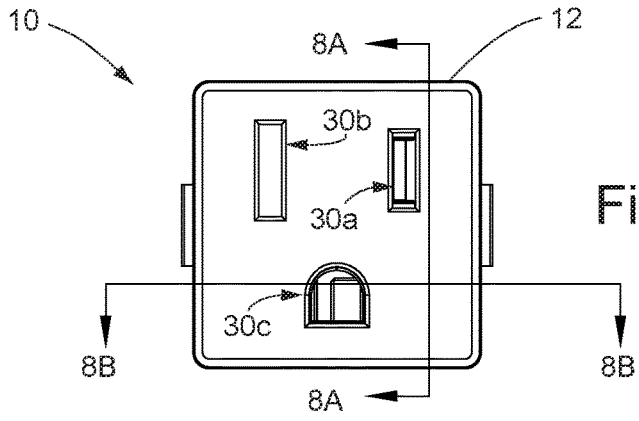
Figure 8A:
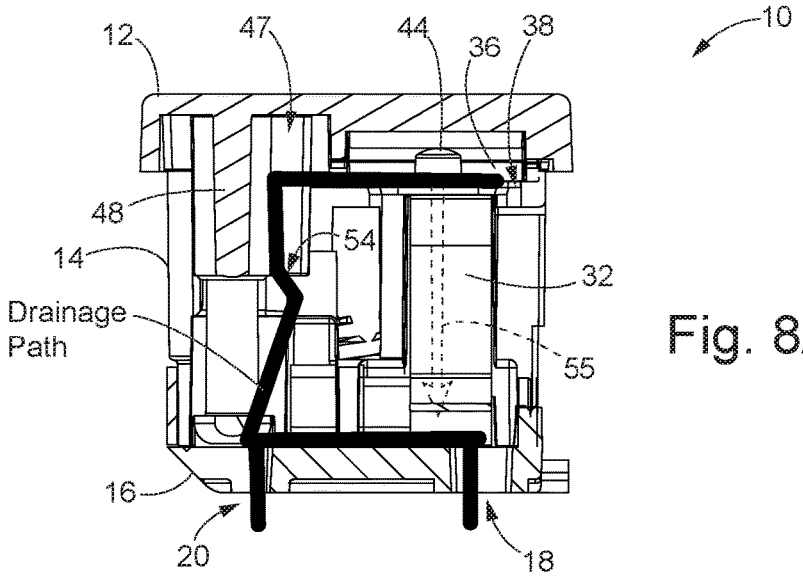
Figure 8B:
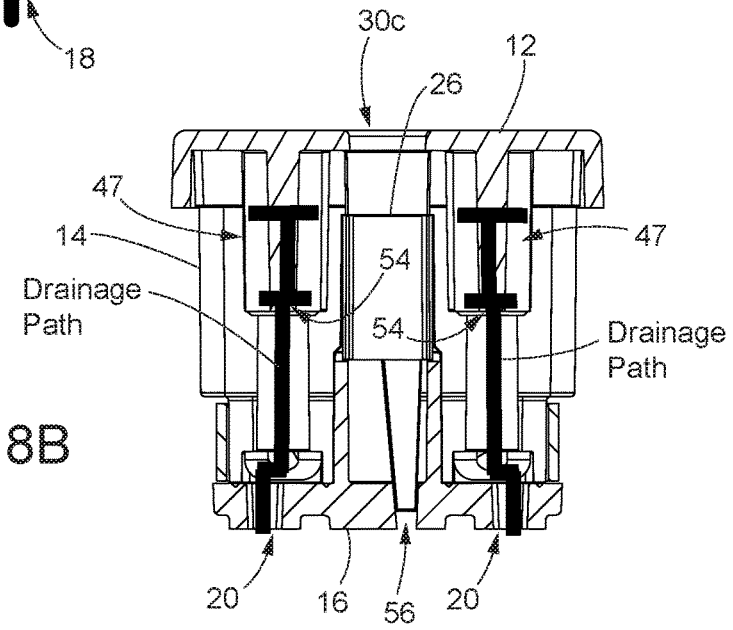
Figure 9:
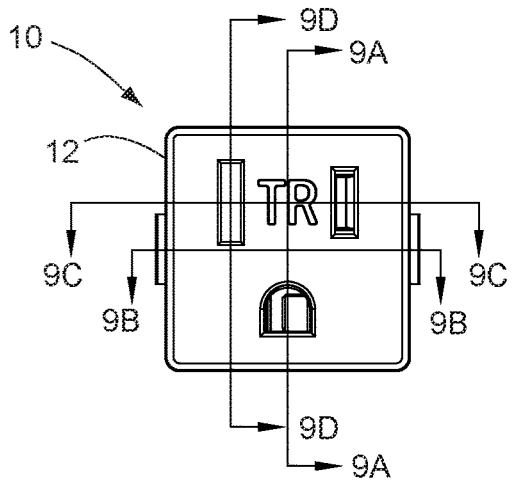
Figure 10:
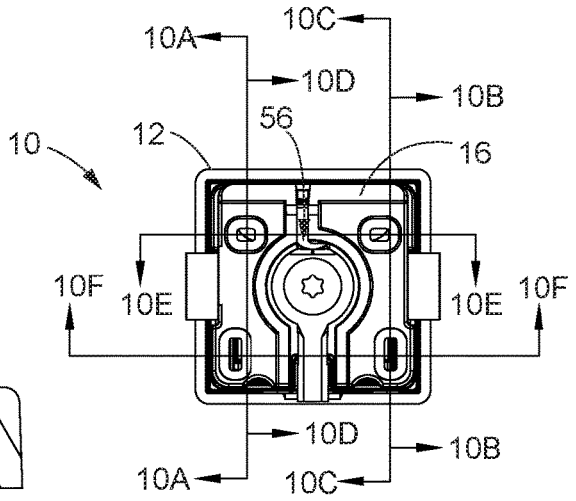
Figure 11:
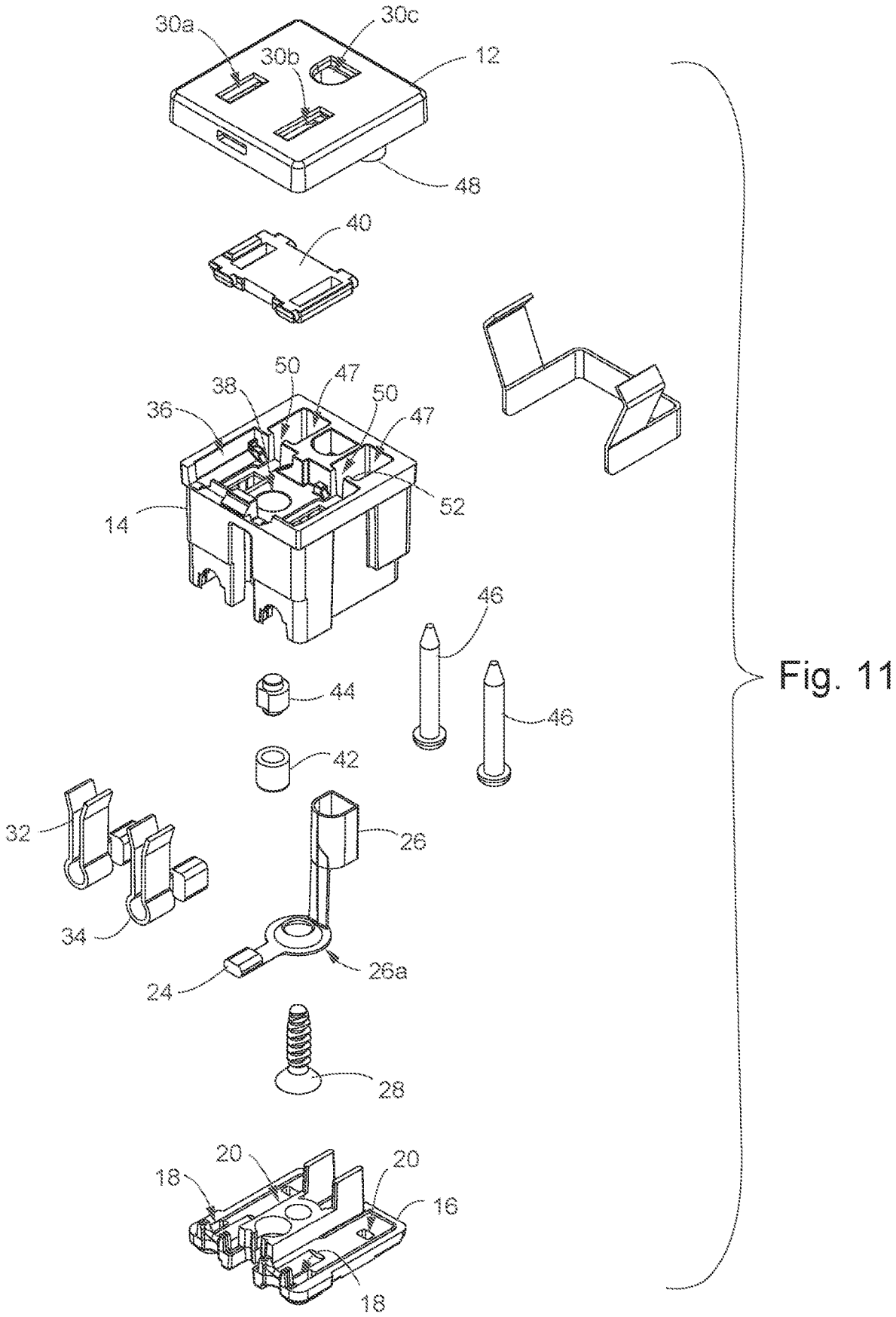
Figure 12:
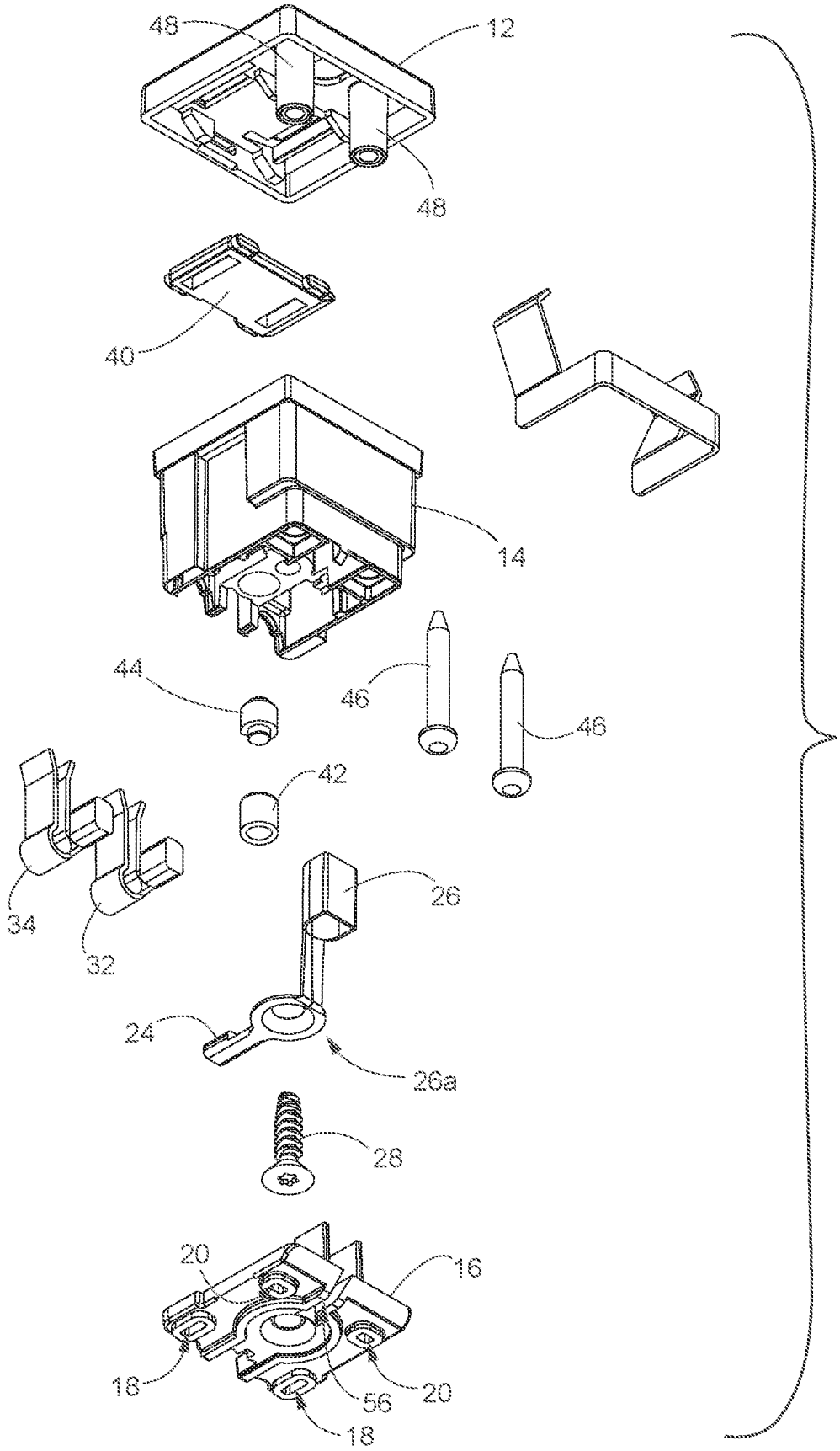

FIGS. 7A, 7B, and 7C are top sectional views taken along respective section lines 7A-7A, 7B-7B, and 7C-7C in FIG. 7;

FIG. 8 is a top plan view of the electrical receptacle assembly of FIG. 1;

FIGS. 8A and 8B are side sectional views taken along respective section lines 8A-8A and 8B-8B in FIG. 8;

FIG. 9 is another top plan view of the electrical receptacle assembly of FIG. 1;

FIGS. 9A, 9B, 9C, and 9D are side sectional views taken along respective section lines 9A-9A, 9B-9B, 9C-9C, and 9D-9D in FIG. 9;

FIG. 10 is a bottom plan view of the electrical receptacle assembly of FIG. 1;

FIGS. 10A, 10B, 10C, 10D, 10E, and 10F are side sectional views taken along respective section lines 10A-10A, 10B-10B, 10C-10C, 10D-10D, 10E-10E, and 10F-10F in FIG. 10;

FIG. 11 is an exploded perspective view of the electrical receptacle assembly of FIG. 1, viewed from above; and FIG. 12 is another exploded perspective view of the electrical receptacle assembly of FIG. 1, viewed from below.

DESCRIPTION OF THE PREFERRED EMBODIMENTS

Figure 3:
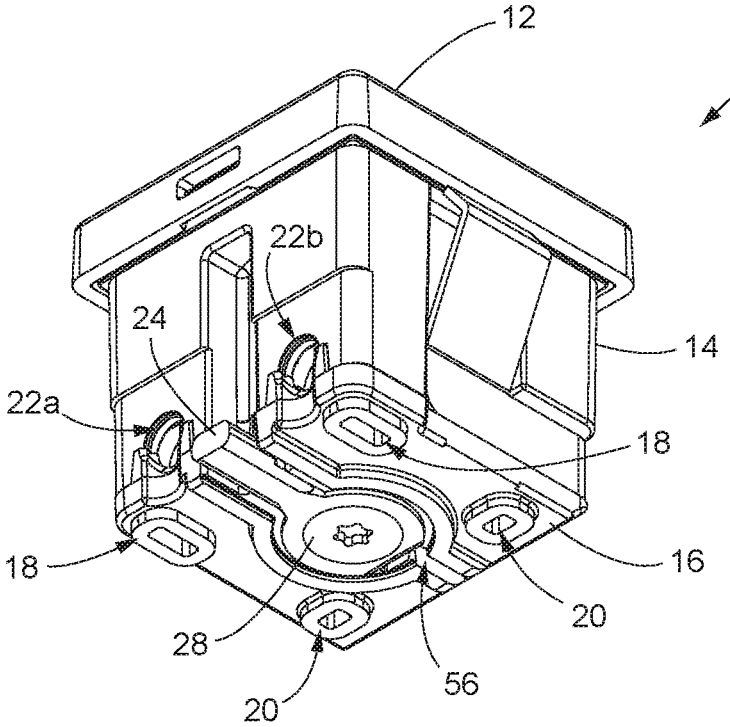
FIG. 3 is a bottom perspective view of the electrical receptacle assembly of FIG. 1, viewed from the front-right side.
Figure 4:
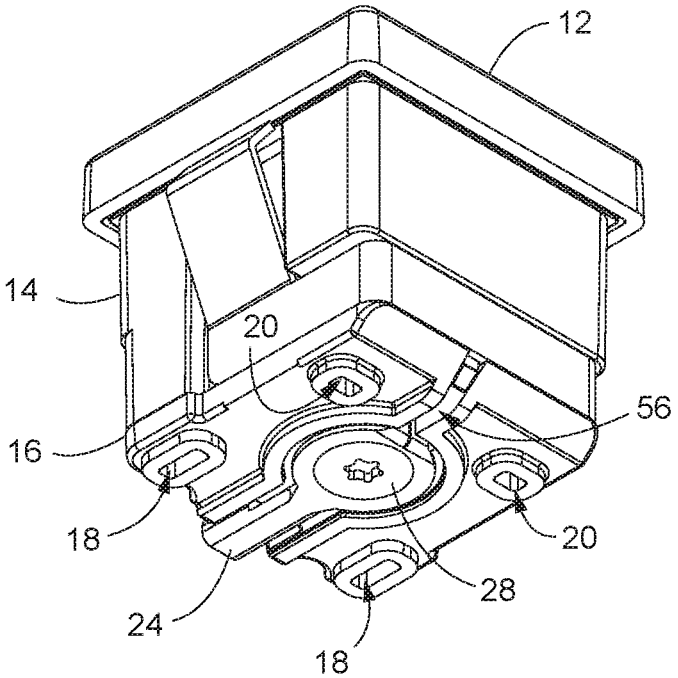
FIG. 4 is another top perspective view of the electrical receptacle assembly of FIG. 1, viewed from the back-right side.

Referring now to the drawing and the illustrative embodiment depicted therein, an electrical power outlet 10 is configured for mounting in a generally face-up orientation (FIGS. 1-4), including in operating environments in which there is a risk of liquid falling onto an upper face 12 of the outlet. It will be understood that a generally face-up orientation is one that is sufficiently close to horizontal that water and similar liquids inadvertently spilled on the face may be expected to pool there, rather than run off due to the force of gravity. The risk of electrical short due to a liquid falling, splashing, or pouring onto the upper face 12 is substantially obviated by the provision of a plurality of drain-through channels formed in a main receptacle body 14 to which the upper face 12 is attached. A lower cover 16 encloses a bottom end of the main receptacle body 14 so that lower cover 16, main receptacle body 14, and upper face 12 cooperate to form a housing body. Lower cover 16 defines four liquid drainage outlets including two line-side drainage outlets 18 and two ground-side drainage outlets 20, such as shown in FIGS. 3 and 4. Lower cover 16 cooperates with a lower end portion of the main receptacle body 14 to define a line conductor passageway 22*a* and a neutral conductor passageway 22*b* that permit the entry of respective line and neutral wires (not shown) into the interior of the receptacle body 14 (FIGS. 1 and 3). A ground conductor passes underneath the lower cover and is mechanically and electrically coupled to a crimping region 24 of a ground contact 26 by a threaded ground fastener 28, the ground contact 26 extending inside of the receptacle body 14.

Upper face 12 defines a line contact opening 30*a*, a neutral contact opening 30*b*, and a ground contact opening 30*c*, which permit respective line, neutral, and ground prongs of a compatible male plug (not shown) to enter the main receptacle body 14 and establish electrical continuity with a line contact 32, a neutral contact 34, and the ground contact 26. As will be described below in more detail, liquid drainage channels or passageways extend through the main receptacle body, from the contact openings 30*a-c* in the upper face to the drainage outlets 18, 20, so that any liquid falling into one or more of the contact openings 30*a-c* is permitted to flow harmlessly through the outlet 10 and out through the drainage outlets 18, 20 without causing a short or electrical continuity because of liquid pooled atop the upper face 12.

Figure 9A:
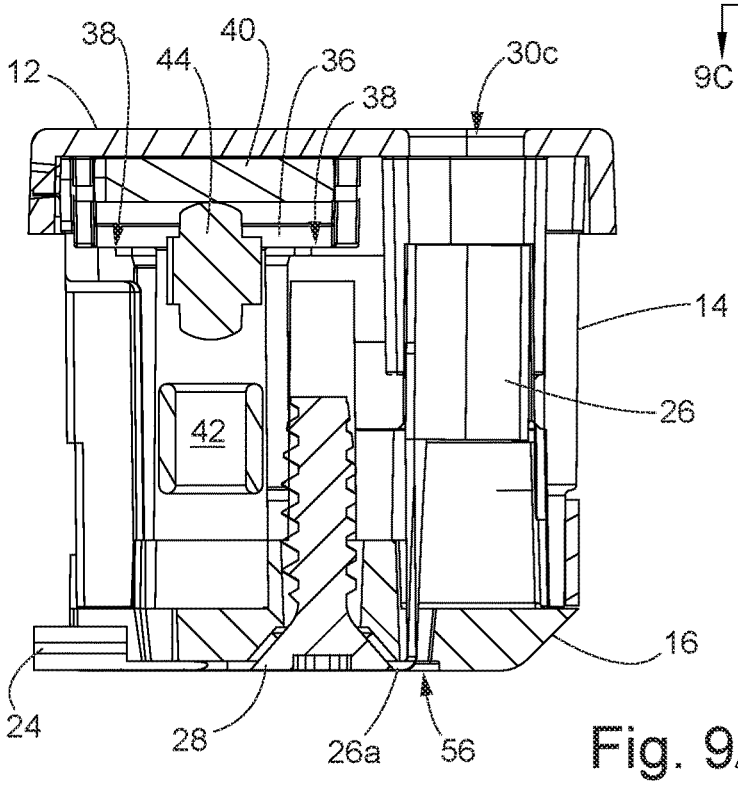
Figure 9B:
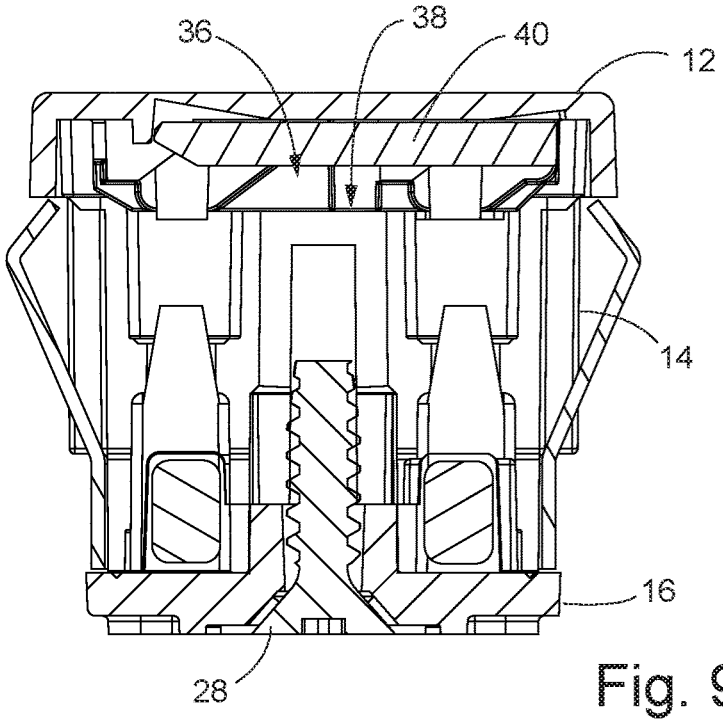
Figure 9C:
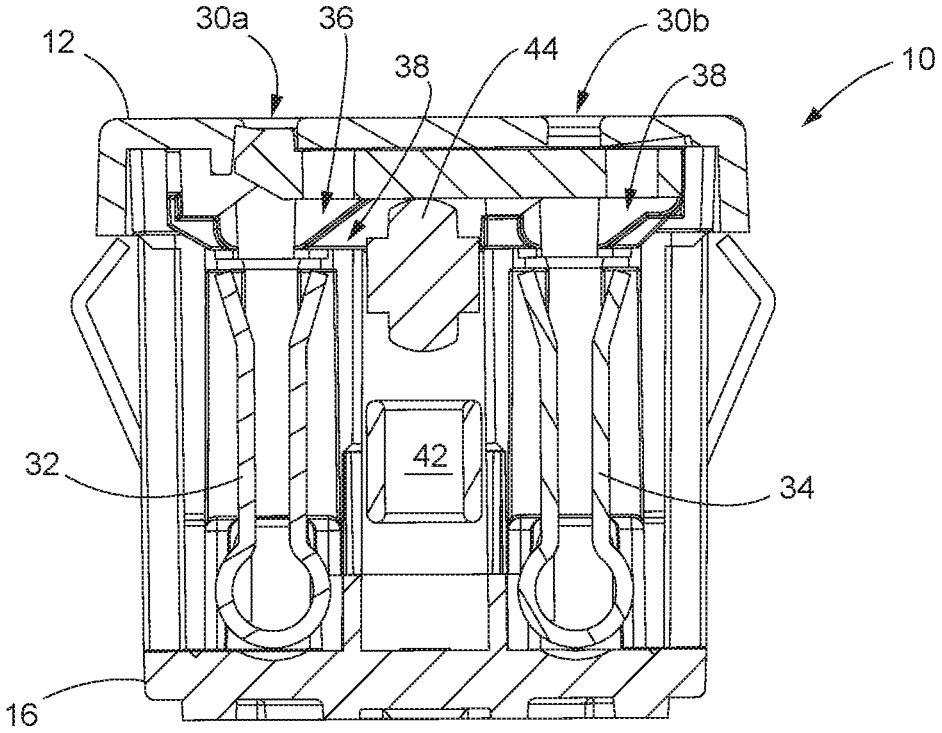
Figure 9D:
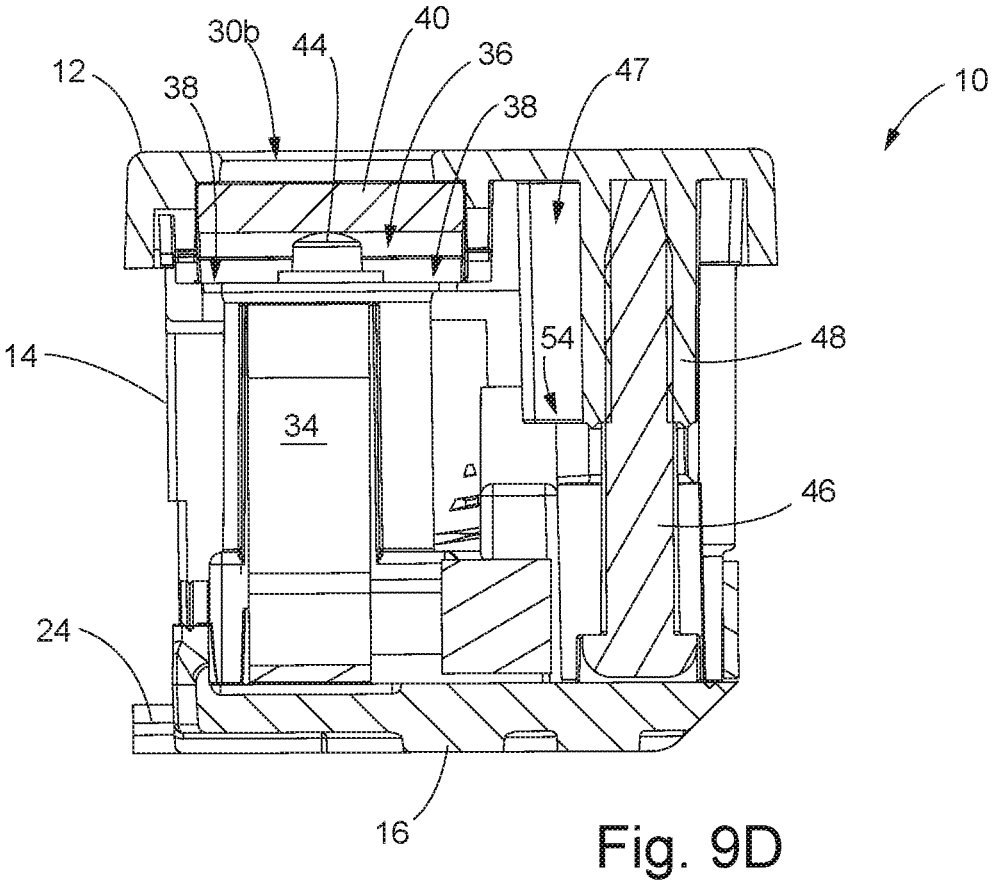
Figure 10A:
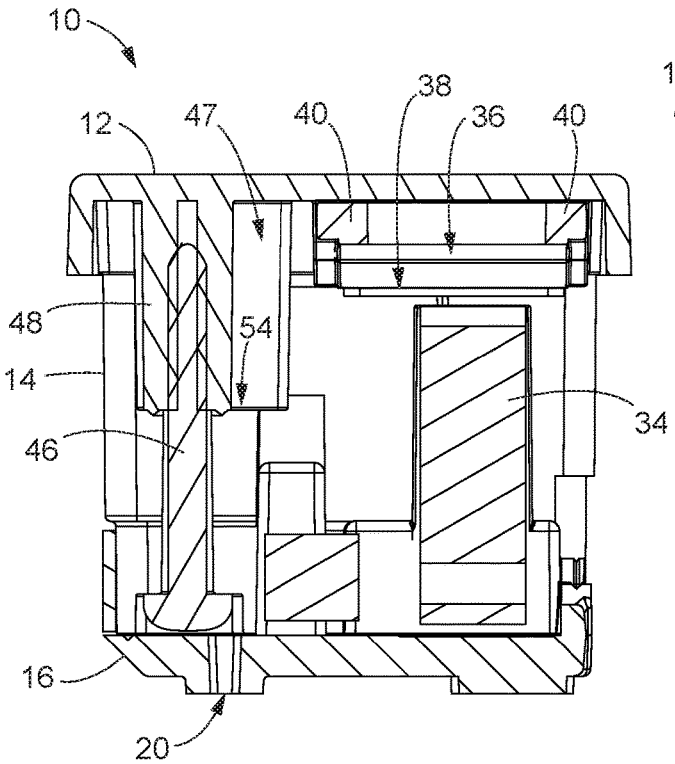
Figure 10B:
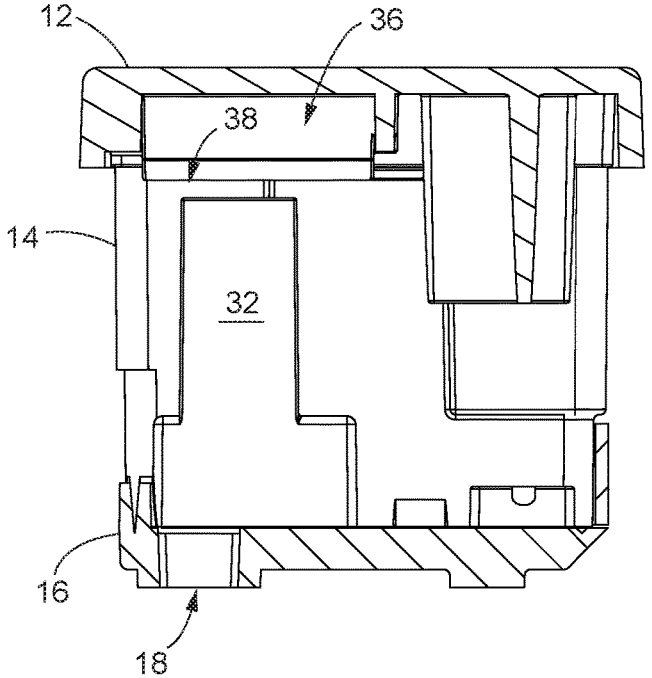
Figure 10C:
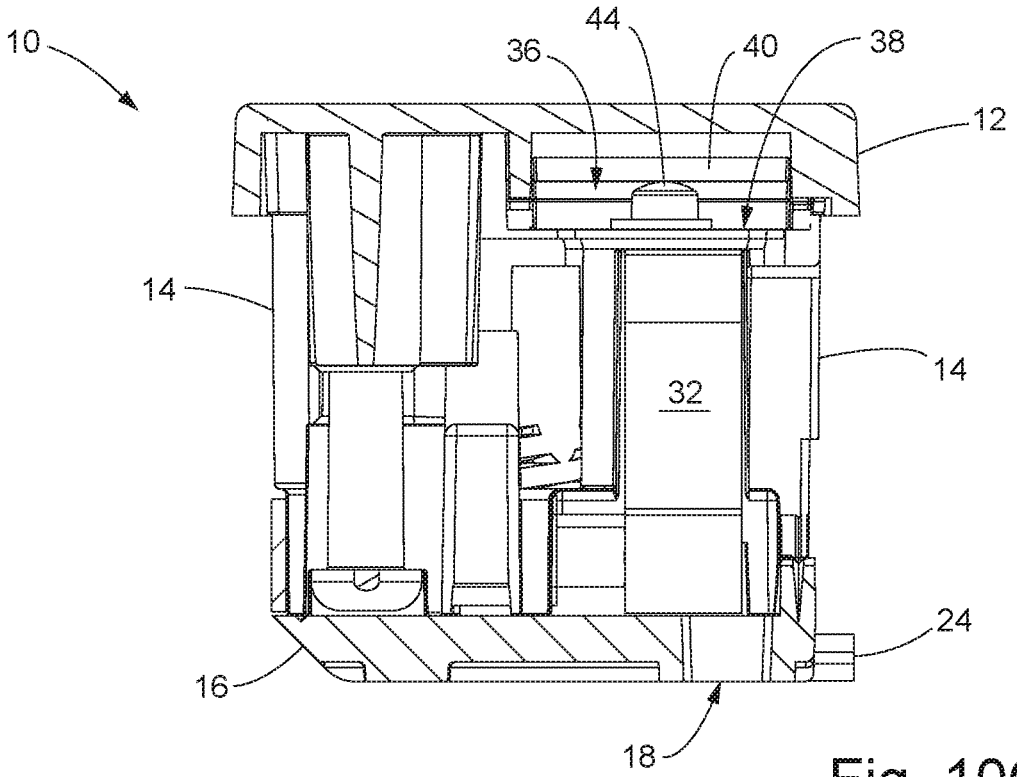
Figure 10D:
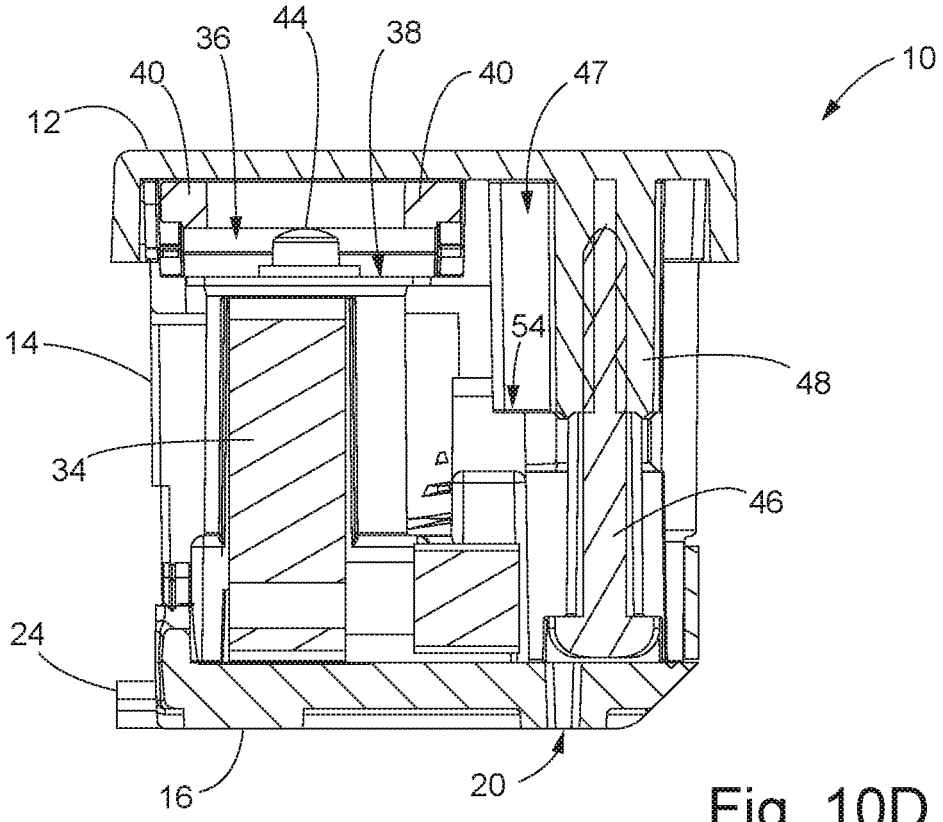

Referring to FIGS. 5, 6, 7A, and 8A, a slider chamber 36 is defined between upper face 12 and a recessed horizontal surface 38 forming an intermediate wall inside the main body 14. Slider chamber 36 receives a slider 40 that is movable between a blocking position (FIGS. 9C and 10F) in which the slider 40 blocks access to the line contact 32 and neutral contact 34 via the line and neutral contact openings 30*a*, 30*b* and the slider chamber 36, a non-blocking position (not shown) in which the slider 40 permits access to the line contact 32 and neutral contact 34 via the slider chamber 36. A coil spring (not shown) is disposed between a collar 42 and a biasing peg 44, to urge the peg 44 upwardly against the underside of the slider 40, causing the slider to return to its blocking position. The various surfaces, components, and movements of the slider 40 and associated structure are more fully described in commonly-owned U.S. Pat. No. 9,059,530 entitled "ACCESS-RESTRICTED ELECTRICAL RECEPTACLE," which is hereby incorporated herein by reference in its entirety. A pair of threaded fasteners 46 pass upwardly through vertical rectangular drainage passageways 47 in the main body 14 and threadedly engage respective screw bosses 48 (FIG. 12) that extend downwardly through the main body's vertical rectangular drainage passageways 17 from the upper face 12 such as shown in FIGS. 9D, 10A, and 10D. Threaded fasteners 46 are installed during assembly of the receptacle 10, prior to securing the lower cover 16 to the lower end portion of the main body 14.

The recessed horizontal surface 38 inside the main body 14, and the bottom of slider chamber 36, receives any liquid passing downwardly through the line and neutral contact openings 30*a*, 30*b* and directs the liquid through a pair of drainage channels 50 formed in walls 52 that otherwise separate the slider chamber 36 from the vertical rectangular drainage passageways 47, such as shown in FIGS. 5, 6, 7A, and 11. Once the liquid is into one of the vertical rectangular drainage passageways 47 it drops down into a lower drainage passage 54 at the bottom of each rectangular drainage passageway 47, which lower drainage passage 54 begins near the lower end of a respective one of the screw bosses 48, as best shown in FIGS. 7B, 8A, 9D, 10A, and 10D. Once the liquid has passed downwardly through the lower drainage passages 54, it flows down to the lower cover 16 and is directed out of the electrical power outlet 10 at ground-side drainage outlets 20 (the most direct path), or runs along an upper surface of the lower cover 16 to the line-side drainage outlets 18, where it exits the electrical power outlet 10 through the lower cover 16, such as shown in FIGS. 8A and 8B.

Figure 5:
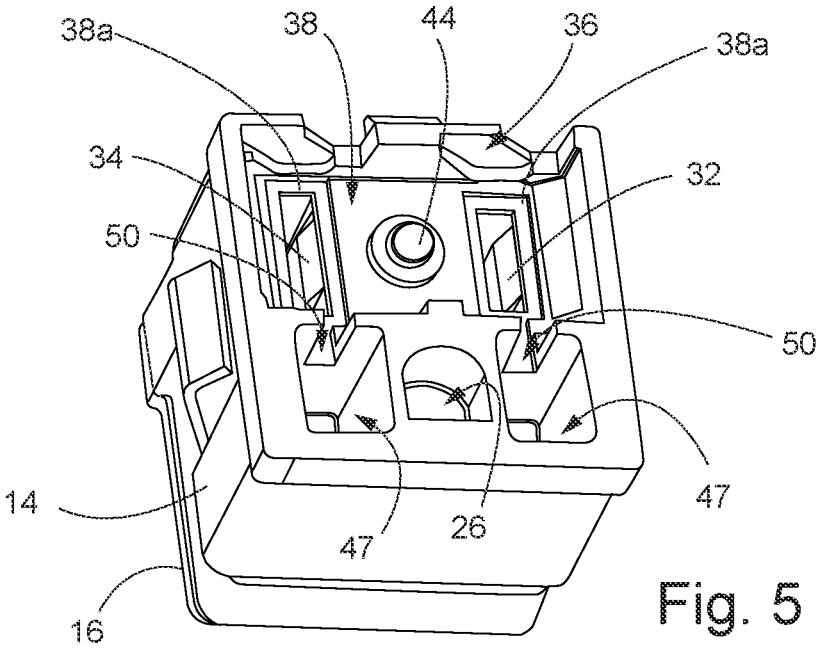
FIGS. 5 and 6 are additional top perspective views of the electrical receptacle assembly of FIG. 1, shown with the face plate removed.
Figure 6:
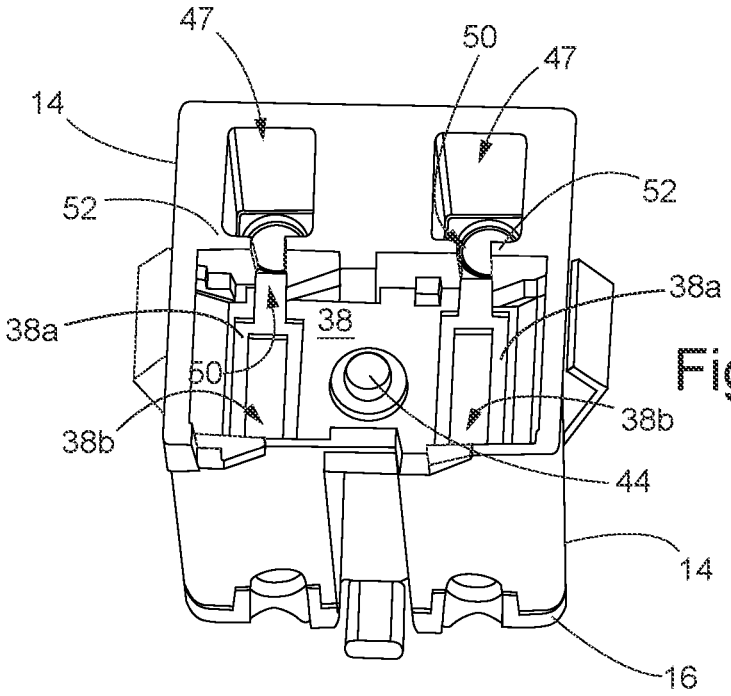

Although most of the liquid flowing into the line and neutral contact openings 30*a*, 30*b* would be expected to follow the alternative flow path illustrated with a heavy dark line in FIG. 8A, starting with a horizontal run along the recessed horizontal surface 38 toward the rectangular drainage passageways 47 (encouraged by recessed regions 38*a* of the surface 38, as shown in FIGS. 5 and 6), it will be appreciated that some liquid may still enter, through contact passageway openings 38*b*, the main body's contact passageways in which the line contact 32 and the neutral contact 34 are mounted. This liquid will flow downwardly through or past the line contact 32 or the neutral contact 34 along a more direct flow path 55 as indicated by a double-dotted arrow in FIG. 8A, and exit the outlet 10 via either the line-side drainage outlets 19 (the most direct path for this particular liquid) or the ground-side drainage outlets 30.

As can be seen in FIG. 7C, the line-side drainage outlets 18 are isolated from one another so that any liquid pooled along the upper surface of the lower cover 16, underneath or in contact with lower portions of the line and neutral contacts 32, 34, cannot establish a continuous liquid path from the line contact 32 to the neutral contact 34. Liquid along the upper surface of the lower cover 16, between each ground-side drainage outlet 20 and its corresponding line-side drainage outlet 18, is isolated from the ground contact 26, which has its own separate drainage path. It will be appreciated that the total combined surface area of the four drainage outlets 18, 20, the total combined surface area of the channels 50, and the total combined surface area of the lower drainage passages 54, may each be approximately equal to the total combined surface area of the line and neutral contact openings 30*a*, 30*b* to ensure that liquid can exit the electrical power outlet 10 at least at the same volumetric rate at which it enters the line and neutral contact openings 30*a*, 30*b*. This would be particularly desirable for applications in which there is no obstruction to the flow of liquid into the line and neutral contact openings 30*a*, 30*b*.

However, it should further be understood that in the illustrated embodiment, in which tamper-proof structure (including slider 40) is provided, any liquid entering through line and neutral contact openings 30*a*, 30*b* would be required to either seep past the slider 40 in its blocking position, or seep through the spaces between prongs of a properly-inserted male plug and the surfaces of the upper face 12 that define line and neutral contact openings 30*a*, 30*b*. Therefore, the available surface area for liquid to pass into the slider chamber 36 via the line and neutral contact openings 30*a*, 30*b* would likely be substantially less than the total combined surface area of the line and neutral contact openings 30*a*, 30*b*, such that the total combined surface area of the four drainage outlets 18, 20, the total combined surface area of the channels 50, and the total combined surface area of the lower drainage passages 54, may each be substantially less than the total combined surface area of the line and neutral contact openings 30*a*, 30*b* while still providing adequate flow.

Figure 10E:
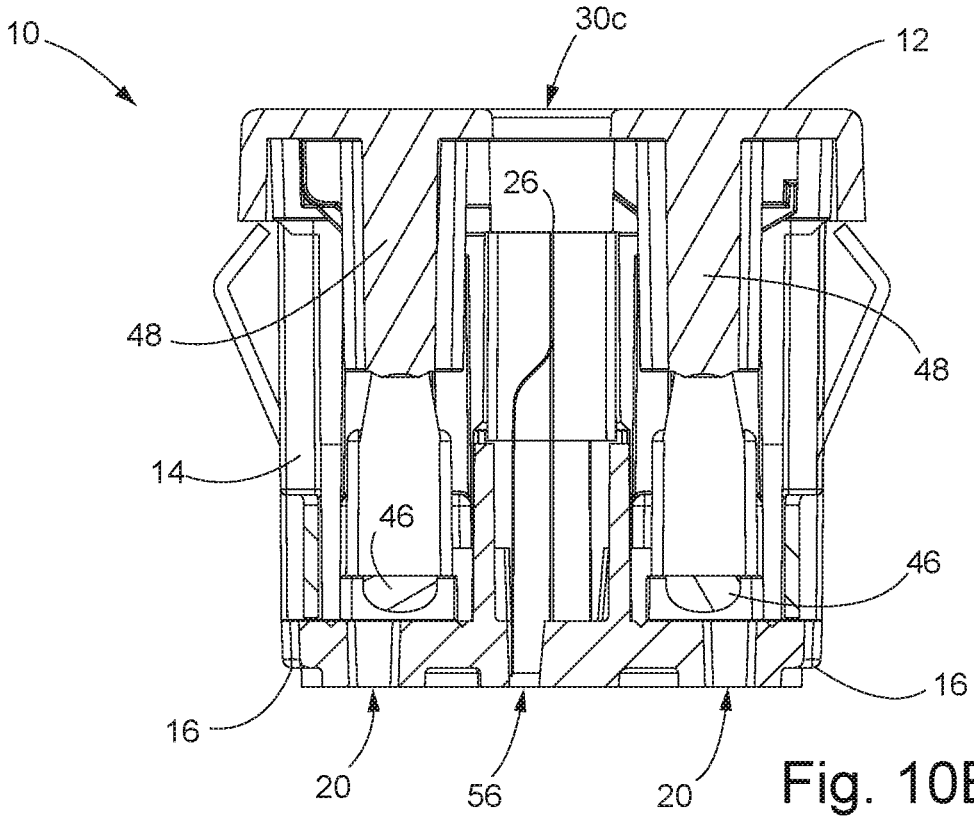
Figure 10F:
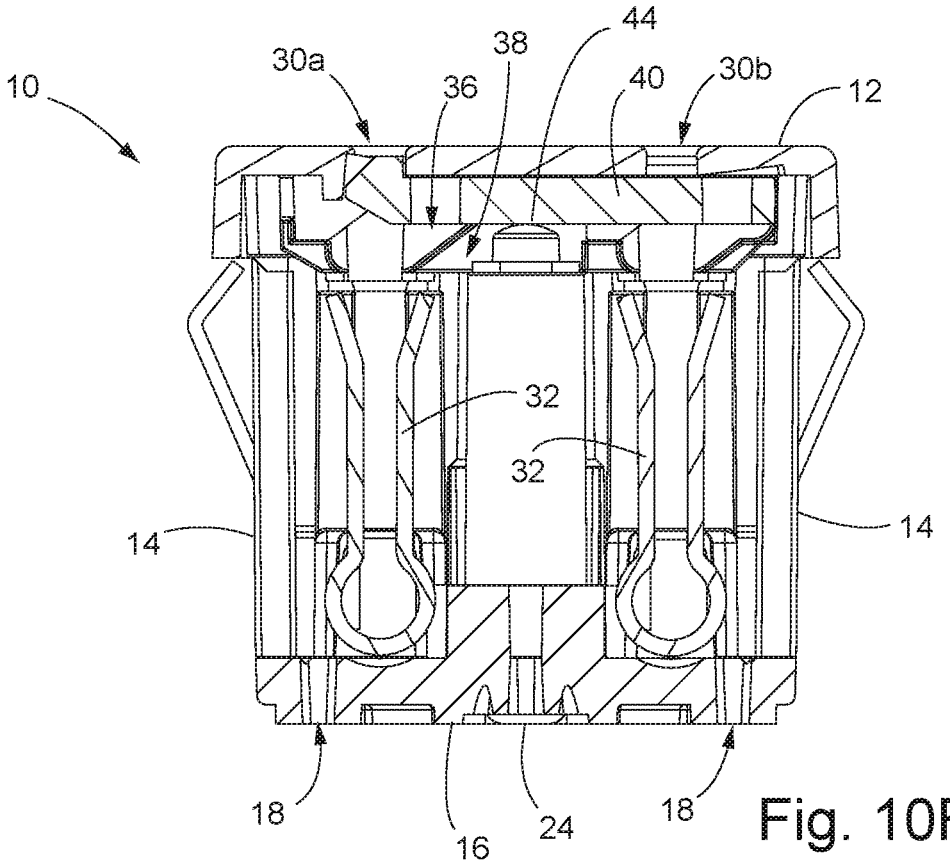

Any liquid passing into the main body 14 through the ground contact opening 30*c* in the upper face 12 will exit the electrical power outlet 10 via a flow path that is isolated from the flow paths illustrated in FIGS. 8A and 8B. As can be seen in FIGS. 8B, 9A and 10E, liquid entering the ground contact opening 30*c* flow nearly directly and substantially unimpeded down through the main body 14 and the ground contact 26, to the lower cover 16 where the liquid exits through a ground drainage outlet 56 proximate the ground fastener 28, which passes through a fastener opening formed in a lower region 26*a* of the ground contact 26, near crimping region 24. Ground drainage outlet 56 or its surrounding surfaces can also be seen in FIGS. 3, 4, 10, and 11. Thus, liquid flowing into the ground contact opening 30*c* is kept isolated from liquid flowing into either of the line or neutral contact openings 30*a*, 30*b* as it passes through the ground contact 26 and out through the ground drainage outlet 56.

Although the primary embodiment described herein is arranged as a NEMA simplex receptacle for 110V AC current, with tamper-resistant features, it will be appreciated that the various features and benefits of the present invention may be applied to other types of receptacles, including non-tamper-resistant outlets configured for 110V or 220V AC current, without departing from the spirit and scope of the present invention. This may be accomplished by altering the dimensions and/or spacing of liquid flow paths or openings, forming slopes along draining surfaces that are illustrated or described herein as being horizontal or substantially horizontal, or other design variations that may also be conceived for accommodating different geometries and electrical current for a given application.

Changes and modifications in the specifically-described embodiments may be carried out without departing from the principles of the present invention, which is intended to be limited only by the scope of the appended claims as interpreted according to the principles of patent law including the doctrine of equivalents.

The embodiments of the invention in which an exclusive property or privilege is claimed are defined as follows:

1. An electrical power outlet comprising:

a housing body comprising a face defining a pair of contact openings, a bottom wall spaced from said face, and a sidewall extending between said face and said bottom wall, said sidewall cooperating with said face and said bottom wall to define an interior chamber;

an intermediate wall positioned in said interior chamber and having an upper surface defining a pair of contact passageway openings;

a pair of contact passageways defined through said interior chamber and open to respective ones of said contact passageway openings;

a pair of drainage passageways extending upwardly from said bottom wall through said interior chamber;

a pair of drainage channels extending along said upper surface of said intermediate wall to respective ones of said drainage passageways; and a pair of drainage outlets formed in said bottom wall and in fluid communication with respective ones of said drainage channels.

2. The electrical power outlet of claim 1, wherein a first of said drainage channels cooperates with a first of said drainage passageways and a first of said drainage outlets to define a first flow path, and a second of said drainage channels cooperates with a second of said drainage passageways and a second of said drainage outlets to define a second flow path that is isolated from said first flow path.

3. The electrical power outlet of claim 1, wherein said drainage passageways are spaced apart and isolated from one another and from each of said contact passageways.

4. The electrical power outlet of claim 1, further comprising a pair of contact-side drainage outlets formed in said bottom wall and in fluid communication with respective ones of said drainage channels, wherein said contact-side drainage outlets are positioned below respective ones of said contact passageways.

5. The electrical power outlet of claim 1, further comprising a pair of upright divider walls disposed between said intermediate wall and respective ones of said drainage passageways, wherein said upright divider walls define respective openings that form respective portions of said drainage channels.

6. An electrical power outlet for mounting in a generally face-up orientation, said electrical power outlet comprising:

a housing body comprising a face defining a pair of contact openings, a bottom wall spaced from said face, and at least one sidewall extending between said face and said bottom wall to define an interior chamber;

a pair of contact passageways defined through said interior chamber;

a pair of electrical contacts mounted in respective ones of said contact passageways;

a pair of drainage passageways extending upwardly from said bottom wall through said interior chamber, and spaced apart from said contact passageways;

an intermediate wall positioned in said interior chamber, spaced below said face, and having an upper surface defining a pair of contact passageway openings at respective upper ends of said contact passageways;

a pair of drainage channels defined in said interior chamber and extending from said upper surface of said intermediate wall to respective ones of said drainage passageways, wherein said drainage channels are configured to direct liquid pooled on said upper surface to said drainage passageways; and a pair of drainage outlets formed in said bottom wall and in fluid communication with respective ones of said drainage channels.

7. The electrical power outlet of claim 6, further comprising a pair of contact-side drainage outlets formed in said bottom wall and in fluid communication with respective ones of said drainage channels, wherein said contact-side drainage outlets are positioned below respective ones of said contact passageways.

8. The electrical power outlet of claim 6, further comprising a pair of upright divider walls disposed between said intermediate wall and respective ones of said drainage passageways, wherein said upright divider walls comprise respective openings forming respective portions of said drainage channels.

9. The electrical power outlet of claim 8, further comprising a shutter movably disposed in a shutter cavity defined between said upright divider walls, said intermediate wall, and said face.

10. The electrical power outlet of claim 6, comprising a third contact passageway and a third electrical contact mounted in said third contact passageway.

11. The electrical power outlet of claim 10, wherein said third contact passageway is disposed between said pair of drainage passageways.

12. The electrical power outlet of claim 10, comprising a third drainage passageway extending upwardly from said bottom wall through said interior chamber and in fluid communication with said third contact passageway, and a third drainage outlet formed in said bottom wall and in fluid communication with said third drainage passageway.

13. The electrical power outlet of claim 12, wherein said third electrical contact comprises an upper portion mounted in said third contact passageway and a lower portion positioned along an exterior bottom surface of said bottom wall.

14. The electrical power outlet of claim 13, wherein said third electrical contact is generally L-shaped with said lower portion angled at about 90 degrees relative to said upper portion.

15. The electrical power outlet of claim 14, further comprising a threaded fastener configured to extend through a fastener opening formed in said bottom wall, and to threadedly engage a fastener bore formed in said housing body, wherein said threaded fastener is configured to engage said lower portion of said third electrical contact and to secure said lower portion of said third electrical contact to said bottom wall.

16. The electrical power outlet of claim 15, wherein said lower portion of said third electrical contact comprises a crimping region at a distal end thereof, said crimping region configured to electrically and mechanically engage a grounding conductor.

17. The electrical power outlet of claim 16, wherein said lower portion of said third electrical contact defines a ground fastener opening located proximal of said crimping region, and wherein said ground fastener opening is configured to receive said threaded fastener.

18. The electrical power outlet of claim 6, wherein said sidewall defines a pair of conductor openings above said bottom wall and configured to receive respective electrical conductors, and wherein said electrical contacts are configured to electrically engage respective ones of the electrical conductors.

19. The electrical power outlet of claim 18, wherein said electrical contacts comprise U-shaped contact regions including lower bite portions, and crimping regions spaced laterally from said lower bite portions and configured to electrically and mechanically engage the respective electrical conductors.

20. The electrical power outlet of claim 19, wherein said electrical contacts are positioned with said lower bite portions adjacent respective ones of said conductor openings, and wherein the electrical conductors extend through respective ones of said lower bite portions and are electrically and mechanically engaged by respective ones of said crimping regions of said electrical contacts.

* * * * *